US007261110B2

(12) United States Patent
Kappes et al.

(10) Patent No.: US 7,261,110 B2
(45) Date of Patent: Aug. 28, 2007

(54) SHAVING APPARATUS CLEANING DEVICE

(75) Inventors: Diana Kappes, Eppstein (DE); Andreas Larscheid, Kelkheim (DE); Uwe Ludäscher, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 11/242,389

(22) Filed: Oct. 3, 2005

(65) Prior Publication Data

US 2006/0048794 A1 Mar. 9, 2006

Related U.S. Application Data

(63) Continuation of application No. PCT/EP2004/001386, filed on Feb. 13, 2004.

(30) Foreign Application Priority Data

Apr. 4, 2003 (DE) ..... 103 15 453

(51) Int. Cl.
*B08B 3/00* (2006.01)
*B08B 3/12* (2006.01)
*B08B 6/00* (2006.01)

(52) U.S. Cl. ..... 134/92; 134/111; 134/137; 134/138; 134/143; 134/166 R; 134/177; 134/178; 134/18; 134/183; 134/188; 134/201

(58) Field of Classification Search ..... 134/166 R, 134/137, 138, 143, 177, 178, 182, 183, 92, 134/111, 186, 201, 188
See application file for complete search history.

(56) References Cited

U.S. PATENT DOCUMENTS

| | | | | |
|---|---|---|---|---|
| 3,172,416 | A | 3/1965 | Simmons | |
| 5,614,030 | A * | 3/1997 | Braun | 134/22.1 |
| 6,131,230 | A | 10/2000 | Manabat | |
| 2002/0078984 | A1* | 6/2002 | Hoser et al. | 134/188 |
| 2005/0189003 | A1* | 9/2005 | Saito et al. | 134/10 |

FOREIGN PATENT DOCUMENTS

| | | |
|---|---|---|
| DE | 690 21 898 | 1/1990 |
| DE | 44 02 238 | 1/1994 |
| EP | 0 743 883 | 6/1999 |
| WO | WO/96/18463 | 6/1996 |

* cited by examiner

*Primary Examiner*—Michael Barr
*Assistant Examiner*—Rita R Patel
(74) *Attorney, Agent, or Firm*—Fish & Richardson P.C.

(57) ABSTRACT

A shaving apparatus cleaning device includes a reservoir for holding a supply of a cleaning fluid and a cleaning receptacle for receiving the shaving apparatus. The reservoir has a discharge orifice through which the cleaning fluid is allowed to flow from the reservoir to the cleaning receptacle. The reservoir and the cleaning receptacle are designed so that the level of the cleaning fluid in the reservoir is higher than a pre-determined minimum level of the cleaning fluid in the cleaning receptacle, and a flow of fluid generated by the difference between levels and flowing from the reservoir to the cleaning receptacle is controllable in dependence upon the actual fluid level in the cleaning receptacle.

18 Claims, 1 Drawing Sheet

SHAVING APPARATUS CLEANING DEVICE

PRIORITY CLAIM

Under 35 U.S.C. §120, this application is a continuation of PCT application serial no. PCT/EP2004/001386 filed Feb. 13, 2004, which claims priority under 35 U.S.C. § 119(a), from German application serial number DE 103 15 453.1, filed Apr. 4, 2003, the entire contents of which are hereby incorporated by reference.

TECHNICAL FIELD

This invention relates to a cleaning device for a shaving apparatus, and methods of its use.

BACKGROUND

Cleaning devices for shaving apparatus are used for the removal of particles of hair and other debris adhering in the shaving head section. Such cleaning devices can be manually or electrically operated.

For example, a manually operated cleaning device disclosed in EP 0 743 883 B1, has two containers for a flushing fluid. One container has a variable volume such that the flushing fluid can be pumped between the containers by varying the volume. The shaving unit is arranged in a receptacle between the containers and can be flushed in the current of fluid. The fluid passes through a filter which retains debris.

U.S. Pat. No. 3,172,416 discloses a cleaning device for an electric razor which has a casing with an access opening for receiving the cutter portion of the razor. The casing accommodates a motor-driven fluid impelling assembly for generating a circulating current of a cleaning fluid, and a collector for accumulating hair and other particles. For cleaning, cleaning fluid is flushed through the cutter portion while, at the same time, the razor which is connected to the cleaning device is set in operation.

DE 44 02 238 C2 discloses a cleaning device for the shaving head of a dry shaver. The cleaning device includes a receptacle for the shaving head of the shaving apparatus and at least one cleaning fluid reservoir. The receptacle is disposed above the level of the cleaning fluid and is adapted to be supplied with cleaning fluid from the cleaning fluid reservoir by means of a motor-driven pumping device. The receptacle is connected with the cleaning fluid reservoir via an overflow device and/or via at least one outlet opening.

DE 690 21 898 T2 discloses a dry shaving apparatus with a drivable shaving member and a separately drivable vibratory device. The vibratory device serves to dislodge hair particles and other debris adhering to the shaving member or other parts of the shaving apparatus. The vibratory device is put in operation by reversing the direction of rotation of the electric motor of the shaving apparatus compared to the direction of rotation used in shaving mode. During this reversed direction of rotation, a vibrating motion is produced by means of a claw coupling which, during operation of the motor in the normal direction of rotation, drives the shaving member. A polarity-reversing switch for reversing the direction of rotation is provided on the shaving apparatus. It is also possible for the electric motor to be put in operation automatically in the reversed direction of rotation for a short period after the shaving apparatus is switched off.

A cleaning device for a shaving apparatus that can be manufactured economically and provides effective cleaning with an acceptable level of user-friendliness is desired.

SUMMARY

In one aspect of the invention, a shaving apparatus cleaning device includes a housing defining a shaving apparatus cleaning receptacle and a reservoir containing a supply of a cleaning fluid and. The reservoir has a discharge orifice through which the cleaning fluid is allowed to flow from the reservoir to the cleaning receptacle. The reservoir and the cleaning receptacle are designed such that a level of the cleaning fluid in the reservoir is higher than a predetermined minimum level of cleaning fluid in the cleaning receptacle, and a flow of fluid generated by the difference between levels of cleaning fluid in the reservoir and receptacle and flowing from the reservoir to the cleaning receptacle is controlled as a function of the actual fluid level in the cleaning receptacle.

With this cleaning device, good cleaning can be achieved at relatively little expense. It is particularly advantageous that no pumping device is needed for the cleaning fluid and also that no other electrical or electronic components are required. A further advantage resides in the ease of operation of the cleaning device. Finally, the cleaning device can operate with little circulation of the cleaning fluid, thus enabling particles of hair and other debris dislodged from the shaving apparatus to settle as sediment so that a relatively clean cleaning fluid is available for each cleaning operation.

In one embodiment, the current of fluid is not allowed to flow from the reservoir to the cleaning receptacle until the actual level of the cleaning fluid in the cleaning receptacle is lower than a predetermined minimum level. This enables the actual level of the cleaning fluid in the cleaning receptacle to be maintained nearly constant, regardless of the filling level of the cleaning fluid in the reservoir. The minimum level may be calculated such that a shaving apparatus arranged in the cleaning receptacle is wetted with the cleaning fluid in to a predefined level. This has the advantage of wetting the shaving apparatus with the cleaning fluid up to a consistent level that is independent of the level of the cleaning fluid in the reservoir.

The discharge orifice of the reservoir may be constructed as a ventilation orifice through which the reservoir is aerated when the actual level of the cleaning fluid in the cleaning receptacle drops below the minimum level. The minimum level may be pre-determined by the position of the discharge orifice. This provides a simple means to maintain a consistent fluid level in the cleaning receptacle. Because no moving parts are necessary, this embodiment of the device operates particularly reliably and without the wear associated with moving parts.

In the cleaning receptacle, provision may be made for a support for the shaving apparatus. The support may define at least one aperture in its bottom area. This has the advantage of enabling particles of hair and/or debris dislodged from the shaving apparatus during the cleaning operation to sink therethrough, leaving the inner part of the support. In this arrangement, it is particularly advantageous for the cleaning receptacle to include a collector in which hair particles and/or debris are allowed to settle. These provisions increase the likelihood that the cleaning fluid is available for cleaning of the shaving apparatus in relatively clean form.

The cleaning device may have a holding device for holding the shaving apparatus in a fixed position above the cleaning receptacle. The shaving apparatus may be parked in this holding device for drying on completion of the cleaning operation. Furthermore, the reservoir may have a viewing window for observing the level of the cleaning fluid. Such a fluid level indicator can be constructed with little expense and is very reliable and precise. A particularly compact and sturdy construction of the cleaning device may be accomplished by making the reservoir and the cleaning receptacle integrally of one piece.

Another aspect of the invention relates to a system comprising a shaving apparatus and the above-described cleaning device for cleaning the shaving apparatus. The shaving apparatus has an actuating device for activating a cleaning function that puts the shaving apparatus into operation temporarily during the cleaning cycle.

The shaving apparatus of the system can be equipped with a cleaning program optimally suited for its type of construction and that the expense for implementing the cleaning program on the cleaning device can he avoided. In this manner, the cleaning device can be provided without any electrical or electronic components, as the control function is performed by the shaving apparatus.

The actuating device may be designed for manual operation. Similarly, it is also possible for the actuating device to be designed for operation via the cleaning device and, hence, for the grip otherwise necessary for operating the actuating device to be dispensed with.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
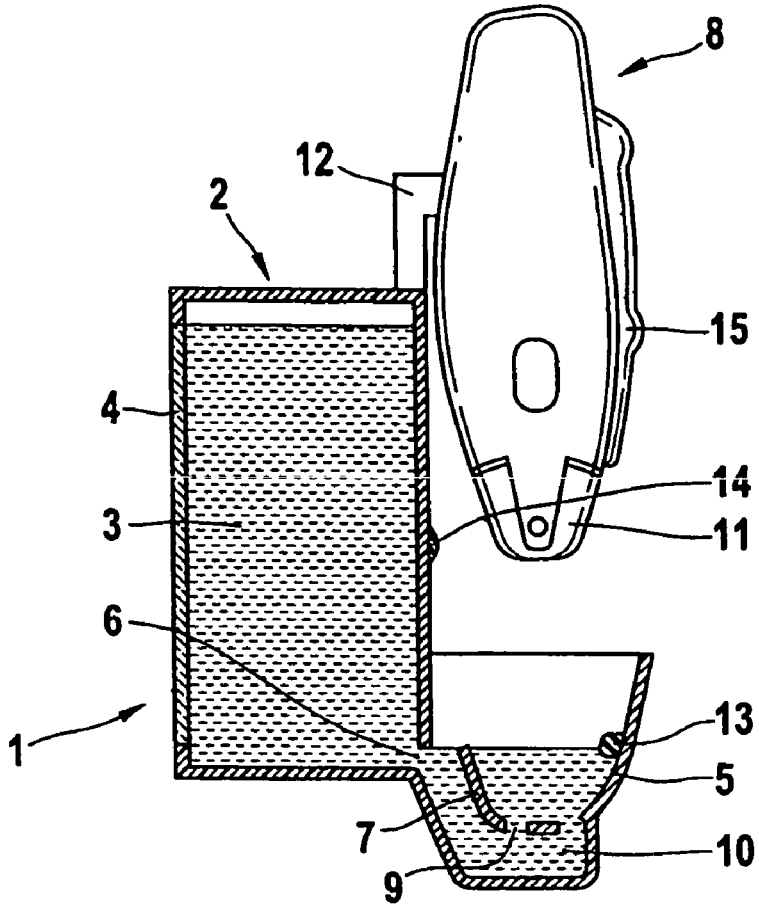
FIG. 1 is a sectional view of a cleaning device showing a shaving apparatus in drying position.

FIG. 1 shows in a cleaning device 1 that has a cartridge 2 for holding a supply of a cleaning fluid 3. Embedded in the side wall of the cartridge 2 is a viewing window 4 for observing the level of the cleaning fluid 3. Formed laterally in the lower portion of the cartridge 2 is a well 5. The well 5 is integrally formed with the cartridge 2 as a single-piece construction. The interior of the cartridge 2 communicates with the well 5 through a discharge orifice 6 in the side wall of the cartridge 2. The cartridge 2 is otherwise hermetically sealed so that fluid can exit from the cartridge 2 and air can enter the cartridge 2 exclusively through the discharge orifice 6. The well 5 has a trough-shaped support 7 for supporting an electric shaving apparatus 8. The support 7 is provided with apertures 9 in its bottom area, which connect the inner area of the support 7 with a collector 10 arranged subjacent the support 7. The apertures 9 are provided, in particular, at the deepest point of the support 7. The support 7 is open in upward direction to enable the shaving head 11 section of the shaving apparatus 8 to be positioned within the support 7. In the operating condition shown in FIG. 1, the shaving apparatus 8 is not parked in the support 7 but fixedly held on a holding device 12 such that the shaving head 11 of the shaving apparatus 8 is disposed above the well 5. This position will be referred to as the drying position because the shaving apparatus 8 is moved to this position after the cleaning operation for drying.

To perform a proper cleaning function on the shaving apparatus 8 by means of the cleaning device 1, it is necessary for the well 5 to be filled with the cleaning fluid 3 at least up to a predetermined minimum level. The cleaning device 1 is constructed in such manner that, when the cleaning fluid 3 in the well 5 drops below the minimum level, the cleaning fluid 3 held in the cartridge 2 is supplied to the well 5 through the discharge orifice 6. In this context, it is notable that the cleaning fluid 3 is not pumped from the cartridge 2 into the well 5 by means of a pump, but that a fluid current from the cartridge 2 into the well 5 is generated by arranging for the level of cleaning fluid 3 in the cartridge to be above the minimum level of the cleaning fluid 3 in the well 5. In the embodiment shown, the minimum level of cleaning fluid 3 in the well 5 is predetermined by the upper edge of the discharge orifice 6. In FIG. 1, the actual level of cleaning fluid 3 in the well 5 equals the minimum level, that is, the well 5 is filled with cleaning fluid 3 up to the upper edge of the discharge orifice 6. In spite of the difference in height between the filling level of the cleaning fluid 3 and the actual level of the cleaning fluid 3 in the well 5, an outflow of cleaning fluid 3 from the cartridge 2 into the well 5 will not occur since the entire cross-sectional area of the discharge orifice 6 on the outside of the cartridge 2 is below the surface of the cleaning fluid 3. In consequence, ambient air is not allowed to flow through the discharge orifice 6 into the otherwise hermetically sealed cartridge 2. Cleaning fluid 3 is allowed to flow out of the cartridge 2 only if the pressure below atmospheric otherwise developing in the cartridge 2 is reduced at least partially by aerating the cartridge 2 through the discharge orifice 6. This means that the cleaning fluid 3 cannot be discharged from the cartridge 2 until the actual level of the cleaning fluid 3 in the well 5 has dropped below the minimum level, thereby clearing the discharge orifice 6 in its upper area.

For example, when the actual level of the cleaning fluid 3 in the well 5 drops below the minimum level due to evaporation of the cleaning fluid 3, ambient air enters the cartridge 2 through the free cross-sectional area of the discharge orifice 6. This causes the pressure below atmospheric in the cartridge 2 to be reduced at least partially, so that the supply of cleaning fluid 3 held in the cartridge 2 flows from the cartridge 2 through the discharge orifice 6 into the well 5. The efflux of cleaning fluid 3 produces an increase in the pressure below atmospheric in the cartridge 2, which can be compensated for by the inflow of ambient air only as long as the actual level of cleaning fluid 3 in the well 5 is below the upper edge of the discharge orifice 6, that is, until the cleaning fluid 3 has reached the minimum level in the well 5. From this instant, the efflux of cleaning fluid 3 from the cartridge 2 results in an increase in the pressure below atmospheric (i.e. the vacuum pressure) in the cartridge 2. Since the pressure below atmospheric counteracts the efflux of cleaning fluid 3 from the cartridge 2, the fluid current is subsequently interrupted.

With each aeration of the cartridge 2 induced by a drop of the actual level of the cleaning fluid 3 in the well 5 below the minimum level, a certain amount of cleaning fluid 3 flows from the cartridge 2 into the well 5, raising the actual level of cleaning fluid 3 in the well 5 above the minimum level. Through the combination of aeration of the cartridge 2 with the efflux of cleaning fluid 3 from the cartridge 2 into the well 5, the actual level of the cleaning fluid 3 in the well 5 is consistently and continuously maintained at least at the height of the minimum level, without requiring active intervention. This increases the likelihood that the shaving apparatus 8 immersed in the well 5 for cleaning purposes is wetted with the cleaning fluid 3 up to a defined level, independent of the filling level in the cartridge 2. The process of cleaning the shaving apparatus 8 by means of the cleaning device 1 will be described in the following with reference to FIG. 2.

Figure 2:
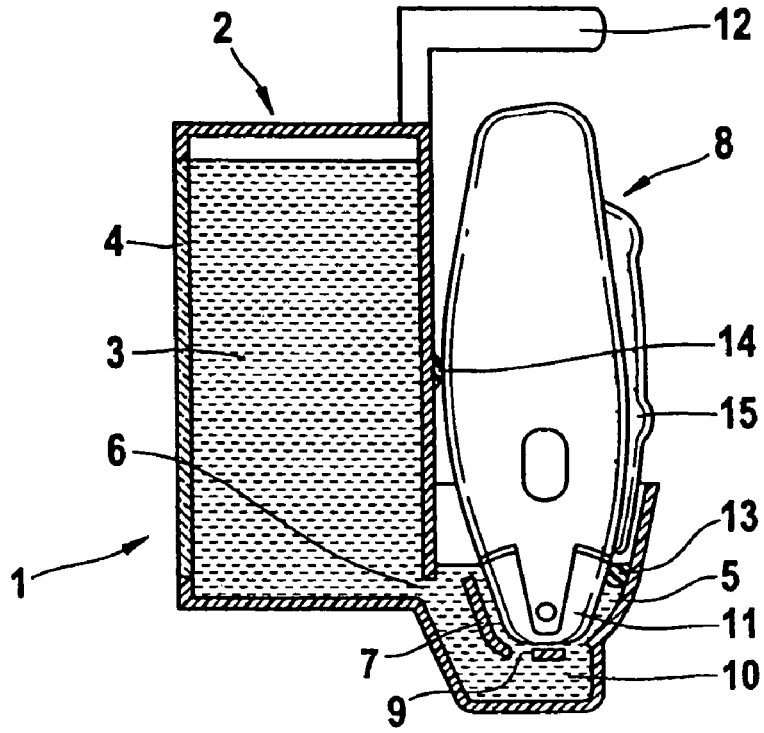
FIG. 2 is a sectional view of the cleaning device of FIG. 1, showing the shaving apparatus in cleaning position.

FIG. 2 shows in a sectional view the cleaning device 1 of FIG. 1 during the cleaning operation. For cleaning purposes, the shaving apparatus 8 is seated with the section of its shaving head 11 on the support 7 in the well 5, occupying the cleaning position illustrated in FIG. 2. In this position, the shaving apparatus 8 bears against the well 5 through a first rubber rest 13 in addition to bearing against a second rubber rest 14 on the side wall of the cartridge 2. A cover, if any, of the well 5 is previously removed. As described with reference to FIG. 1, prior to arranging the shaving apparatus 8 in the support 7, the well 5 is filled with the cleaning fluid 3 up to the upper edge of the discharge orifice 6. Because a certain amount of fluid is displaced by the shaving apparatus 8, the fluid level in the well 5 will slightly rise when the shaving apparatus 8 is immersed. Allowance is made for this rise in the design of the well 5 and the discharge orifice 6, so that the shaving apparatus 8 is wetted with the cleaning fluid 3 up to a defined level.

Subsequent to a brief soaking period, the shaving apparatus 8 is put into operation for about one to two minutes. The soaking period is calculated to enable effective cleaning of the shaving head 11 in the subsequent operating stage without unnecessarily prolonging the overall time required for the cleaning cycle. The shaving apparatus 8 can be put into operation in a variety of ways. In the embodiment shown in FIG. 2, the shaving apparatus 8 is switched on and, after a desired time period, is switched off again manually using a switch 15 that is also used for switching the shaving apparatus 8 on and off for shaving purposes. In a variation, not illustrated, provision is made on the shaving apparatus 8, in addition to the switch 15, for a cleaning button to activate a cleaning program with which the shaving apparatus 8 is put into operation automatically for one or more time periods after manual operation of the cleaning button. In this case, a soaking period is provided between the operating stages. In another variation, the shaving apparatus 8 is equipped with an actuating device to activate the cleaning program, which is automatically actuated by the cleaning device 1 when the shaving head 11 is immersed in the well 5, with the result that the cleaning program is started automatically.

Putting the shaving apparatus 8 into operation enables an intensive cleaning effect to be accomplished, and particles of hair and other debris can be removed from the section of the shaving head 11. This effect is due to a relative movement between the cleaning fluid 3 and the components of the shaving head 11. This movement is generated with the aid of the drive motor of the shaving apparatus 8, thereby obviating the need to equip the cleaning device 1 with an electrically driven pumping device for the cleaning fluid 3. The dislodged particles of hair and debris can sink through the apertures 9 in the support 7 to the bottom of the collector 10 and settle there. In this arrangement, the support 7 largely prevents the particles of hair and debris from being agitated again when the shaving apparatus 8 is nut into operation. The cleaning cycle can he optimized with regard to the cleaning result and the time required overall for the cleaning by varying the length of operating times for the shaving apparatus 8 and the soaking times in between.

On completion of the cleaning cycle, the shaving apparatus 8 is removed from the well 5 and arranged in the drying position illustrated in FIG. 1. This includes fastening the shaving apparatus 8 to the holding device 12 such that the shaving head 11 is arranged above the well 5. In this position, it is possible, for example, for any remnants of the cleaning fluid 3 remaining on the shaving head 11 to drip into the well 5. When the shaving apparatus 8 is dry, the well 5 is covered if a suitable cover is provided on the cleaning device 1.

A number of embodiments of the invention have been described. Nevertheless, it will be understood that various modifications may be made without departing from the spirit and scope of the invention. Accordingly, other embodiments are within the scope of the following claims.

What is claimed is:

1. A shaving apparatus cleaning device comprising:

a housing defining a shaving apparatus cleaning receptacle; and a reservoir containing a supply of a cleaning fluid, the reservoir having a discharge orifice at the bottom of the reservoir through which the cleaning fluid is allowed to flow from the reservoir to the cleaning receptacle;

wherein the reservoir and the cleaning receptacle are designed such that a level of the cleaning fluid in the reservoir is higher than a predetermined minimum level of cleaning fluid in the cleaning receptacle, and a flow of cleaning fluid resulting from a difference between levels of cleaning fluid in the reservoir and the cleaning receptacle and flowing from the reservoir to the cleaning receptacle is controlled by an actual level of the cleaning fluid in the cleaning receptacle.

2. The shaving apparatus cleaning device according to claim 1, wherein the discharge orifice limits the flow of cleaning fluid from the reservoir to the cleaning receptacle until the actual level of the cleaning fluid in the cleaning receptacle is lower than the predetermined minimum level.

3. The shaving apparatus cleaning device according to claim 1, wherein the minimum level is selected such that the shaving apparatus is wetted with the cleaning fluid up to a defined level when the shaving apparatus is arranged in the cleaning receptacle.

4. The shaving apparatus cleaning device according to claim 1, wherein the discharge orifice of the cleaning fluid reservoir is constructed as a ventilation orifice through which the cleaning fluid reservoir is aerated when the level of the cleaning fluid in the cleaning receptacle drops below the minimum level.

5. The shaving apparatus cleaning device according to claim 4, wherein the minimum level is established by a position of the discharge orifice.

6. The shaving apparatus cleaning device according to claim 1 further comprising a shaving apparatus support supporting the shaving apparatus.

7. The shaving apparatus cleaning device according to claim 6, wherein the shaving apparatus support defines at least one aperture in its bottom area.

8. The shaving apparatus cleaning device according to claim 1, wherein the cleaning receptacle includes a collector configured to settle particles in the cleaning fluid.

9. The shaving apparatus cleaning device according to claim 1 further comprising a shaving apparatus holding device configured to hold the shaving apparatus in a fixed position while suspended above the cleaning receptacle.

10. The shaving apparatus cleaning device according to claim 1, wherein the cleaning fluid reservoir has a viewing window through which the level of the cleaning fluid is visible.

11. The shaving apparatus cleaning device according to claim 1, wherein the cleaning fluid reservoir and the cleaning receptacle are defined by a single, integral piece of material.

12. A shaver system comprising:

a shaving apparatus cleaning device constructed in accordance with claim 1; and a shaving apparatus, the shaving apparatus having an actuating device configured to activate a cleaning function that puts the shaving apparatus into operation temporarily during a cleaning cycle.

13. The shaver system according to claim 12, wherein the actuating device is manually operable.

14. The shaver system according to claim 12, wherein the actuating device is operable by the cleaning device.

15. A shaving system comprising:

an electric shaving apparatus; and a cleaning device defining a cleaning receptacle that receives a head of the shaving apparatus, the cleaning device containing a reservoir holding a supply of the cleaning fluid, the reservoir in fluid communication with the cleaning receptacle through a discharge orifice below the reservoir;

wherein the discharge orifice is exposed to atmosphere when an actual level of cleaning fluid in the cleaning receptacle is below a pre-determined minimum level, such that a difference between a level of fluid in the reservoir and the actual level of fluid in the cleaning receptacle causes a flow of cleaning fluid from the reservoir through the discharge orifice to the cleaning receptacle.

16. The shaving system according to claim 15, wherein the discharge orifice limits the flow of cleaning fluid from the reservoir to the cleaning receptacle until the actual level of the cleaning fluid in the cleaning receptacle is lower than the minimum level.

17. The shaving system according to claim 15, wherein the minimum level is selected such that the shaving apparatus is wetted with the cleaning fluid up to a predefined level when the shaving apparatus is arranged in the cleaning receptacle.

18. The shaving system according to claim 15, further comprising a shaving apparatus support supporting the shaving apparatus, the shaving apparatus support defining at least one aperture extending through the support.

* * * * *